US010744806B2

(12) United States Patent
Knaack et al.

(10) Patent No.: US 10,744,806 B2
(45) Date of Patent: Aug. 18, 2020

(54) OBSCURING RESIDUAL IMAGES ON PRINT RIBBONS

(71) Applicant: Entrust Datacard Corporation, Shakopee, MN (US)

(72) Inventors: John Knaack, Shakopee, MN (US); Rajesh K. Juriasingani, Shakopee, MN (US); Patrick C. Cronin, Shakopee, MN (US)

(73) Assignee: Entrust Datacard Corporation, Shakopee, MN (US)

( * ) Notice: Subject to any disclaimer, the term of this patent is extended or adjusted under 35 U.S.C. 154(b) by 0 days.

(21) Appl. No.: 16/429,898

(22) Filed: Jun. 3, 2019

(65) Prior Publication Data

US 2019/0366750 A1 Dec. 5, 2019

Related U.S. Application Data

(60) Provisional application No. 62/680,222, filed on Jun. 4, 2018.

(51) Int. Cl.
*B41M 5/025* (2006.01)

(52) U.S. Cl.
CPC ..... *B41M 5/025* (2013.01)

(58) Field of Classification Search
CPC ..... B41M 5/025
See application file for complete search history.

(56) References Cited

U.S. PATENT DOCUMENTS

| | | | |
|---|---|---|---|
| 4,531,135 | A | 7/1985 | Toshima |
| 4,651,162 | A | 3/1987 | Nakamura |
| 4,825,054 | A | 4/1989 | Rust |
| 4,845,549 | A | 7/1989 | Someya |
| 5,266,781 | A | 11/1993 | Warwick |
| 6,783,067 | B2 | 8/2004 | Kreuter |
| 6,894,710 | B2 | 5/2005 | Suzuki |
| 6,902,107 | B2 | 6/2005 | Shay |

(Continued)

FOREIGN PATENT DOCUMENTS

| | | |
|---|---|---|
| FR | 2988509 | 9/2013 |
| JP | 2005-014398 | 1/2005 |

(Continued)

OTHER PUBLICATIONS

International Search Report with Written Opinion documentation dated Oct. 22, 2019 for International application No. PCT/IB2019/054592.

*Primary Examiner* — Lamson D Nguyen
(74) *Attorney, Agent, or Firm* — Hamre, Schumann, Mueller & Larson, P.C.

(57) ABSTRACT

Techniques are described for obscuring residual images on print ribbons that have been used to print on plastic cards in order to prevent access to sensitive or personalized data appearing in the residual images. An image is printed on a retransfer film using the print ribbon, thereby creating a residual image of the printed image on the print ribbon. The retransfer film is then used to obscure some or all of the residual image on the print ribbon by transferring ink from the section of the print ribbon containing the residual image onto the retransfer film. In some embodiments, obscuring the residual image on the print ribbon occurs before the printed image on the retransfer film is transferred to the plastic card.

17 Claims, 5 Drawing Sheets

(56) References Cited

U.S. PATENT DOCUMENTS

| | | | | |
|---|---|---|---|---|
| 7,021,666 | B2 * | 4/2006 | Hare | B41M 5/035 156/60 |
| 7,398,972 | B2 | 7/2008 | Schuller | |
| 7,434,728 | B2 | 10/2008 | Paulson | |
| 7,839,425 | B2 * | 11/2010 | Morrison | B41J 3/60 347/171 |
| 8,231,935 | B2 | 7/2012 | Ihara | |
| 8,668,396 | B2 | 3/2014 | Ihara | |
| 8,933,978 | B1 | 1/2015 | Fowell | |
| 9,007,649 | B2 | 4/2015 | Higashi | |
| 9,079,423 | B2 | 7/2015 | Bouverie | |
| 10,232,640 | B2 | 3/2019 | Merlet | |
| 10,427,429 | B2 | 10/2019 | Godard | |
| 2013/0002786 | A1 | 1/2013 | Ihara | |
| 2018/0134050 | A1 | 5/2018 | Merlet | |

FOREIGN PATENT DOCUMENTS

| | | |
|---|---|---|
| JP | 2008-114383 | 5/2008 |
| JP | 2010-115861 | 5/2010 |
| WO | 2013-137880 | 9/2013 |
| WO | 2017-162601 | 9/2017 |

* cited by examiner

OBSCURING RESIDUAL IMAGES ON PRINT RIBBONS

FIELD

This disclosure relates generally to printing on plastic cards including, but not limited to, financial (e.g., credit, debit, or the like) cards, driver's licenses, national identification cards, business identification cards, gift cards, and other plastic cards.

BACKGROUND

Plastic cards are commonly printed using a suitable printing mechanism in a card processing system. One known plastic card printing mechanism is a retransfer printer. Retransfer printing is a known printing process where an image is printed by a printing mechanism onto an intermediate retransfer material by transferring ink from a print ribbon onto the intermediate retransfer material. After the image is printed, the intermediate retransfer material is transferred by lamination onto the surface of the plastic card that is to bear the printed image. Further information on retransfer printing can be found in, for example, U.S. Pat. No. 6,894,710 which is incorporated herein by reference in its entirety. Another known plastic card printing mechanism is a direct-to-card printing mechanism where the printing is applied directly to a surface of the plastic card from a print ribbon.

As a result of transferring the ink from the print ribbon, a residual image of the printed image is left on the print ribbon. The residual image can be sensitive information such as a personal account number, the name of the intended cardholder, a portrait image of the intended cardholder, and the like. Therefore, someone may be able to obtain the sensitive information from the print ribbon for unauthorized purposes such as creating a fraudulent plastic card, making unauthorized purchases using the obtained information, or stealing the cardholder's identity.

SUMMARY

Techniques are described for obscuring residual images on print ribbons that have been used to print on plastic cards. Obscuring the residual images on the print ribbons prevents access to sensitive or personalized data appearing in the residual images. The plastic cards can be financial (e.g., credit, debit, or the like) cards, driver's licenses, national identification cards, business identification cards, gift cards, and other plastic or composite cards which bear personalized data unique to or assigned specifically to the cardholder and/or which bear other card information. The term "plastic card" as used herein is intended to encompass cards that are completely or substantially plastic, as well as cards that have non-plastic or composite components and cards having other formulations that function like the card types indicated above.

Cards that are encompassed by the term "plastic cards" often bear printed personalized data unique to or assigned specifically to the cardholder, such as the name of the cardholder, an account number, an image of the face of the cardholder, and other data. In some embodiments, the cards can include a magnetic stripe and/or integrated circuit chip that holds/stores personalized data unique to or assigned specifically to the cardholder. Unauthorized access to the personalized data can be used for illegitimate purposes, such as creating a fraudulent plastic card, making unauthorized purchases, or identity theft.

As used herein, the term "obscure", "obscuring" and the like is intended to encompass rendering the residual image of some or all the personalized or sensitive data (or any other data that one may wish to obscure) on the print ribbon unintelligible or unclear to a casual viewer of the print ribbon. The term "obfuscate" or "obfuscation" may alternatively be used in place of "obscure" or "obscuring".

In the techniques described herein, an image is printed on a retransfer film using a print ribbon, thereby creating a residual image of the printed image on the print ribbon. The retransfer film is also used to obscure some or all of the residual image on the print ribbon by transferring ink from the section of the print ribbon containing the residual image onto the retransfer film.

In one embodiment, a print ribbon obscuration method includes printing an image on a retransfer film by transferring ink from a section of a print ribbon onto a transferrable printing receptive layer of a first section of the retransfer film thereby forming a residual image of the image on the section of the print ribbon. Thereafter, the residual image on the section of the print ribbon is obscured by transferring ink from the section of the print ribbon onto a second section of the retransfer film that is spaced from the first section bearing the image.

In another embodiment, a method of printing an image onto a surface of a plastic card includes printing at least a portion of the image onto a transferrable printing receptive layer of a retransfer film by transferring ink from a print ribbon onto the transferrable printing receptive layer thereby forming a residual image on the print ribbon. The residual image on the print ribbon is then obscured. After obscuring the residual image, the transferrable printing receptive layer bearing the printed image is transferred onto the surface of the plastic card.

In still another embodiment, a method of operating a plastic card printing mechanism includes allowing a user of the plastic card printing mechanism to select an obscuration image or obscuration pattern to be used to obscure a residual image left behind on a print ribbon resulting from a print operation performed by the plastic card printing mechanism. A user input of a selected obscuration image is received, and the residual image in the print ribbon is then obscured based on the received user input.

The techniques described herein limit the extent of reverse movement of the print ribbon to achieve obscuration of the residual image which minimizes wrinkling in the print ribbon and improves registration of the print ribbon with the retransfer film. For example, in an example where the print ribbon contains multiple discrete panels of colored ink (for example such as a CMYK print ribbon), the print ribbon can be moved in reverse a distance approximately equal to a single panel to obscure the residual image on the single panel. This single panel reverse movement, followed by obscuring the residual image on the single panel, can be repeated for each panel prior to transferring the final image to the plastic card.

DRAWINGS

FIGS. 3A-E illustrate an example of obscuring a residual image on a section of a print ribbon bearing a single color.

FIGS. 4A-I illustrate an example of obscuring residual images on panels of a multi-color print ribbon.

Figure 5:
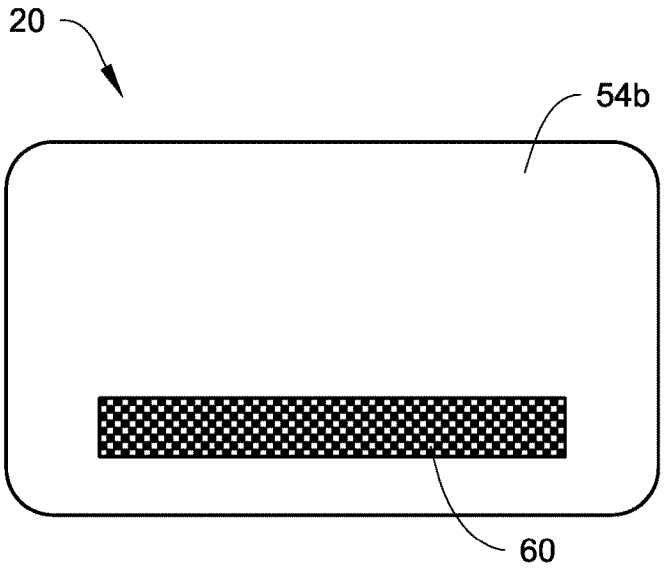

FIG. 5 illustrates a section of retransfer film with another example of obscuring a residual image.

Figure 6:
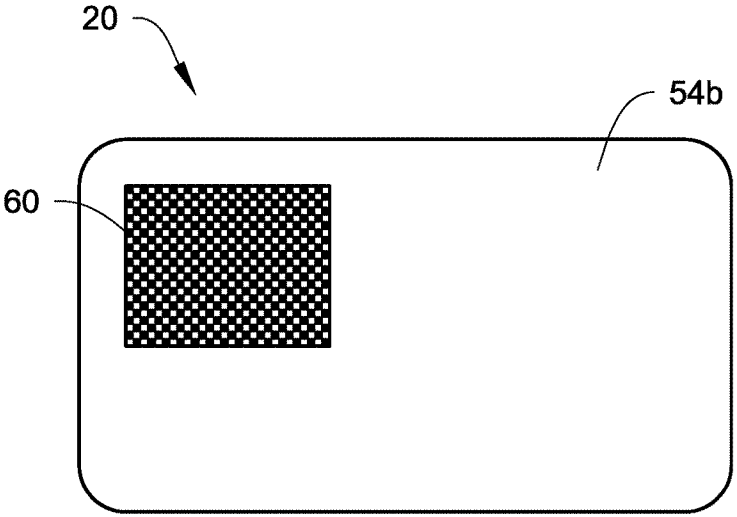

FIG. 6 illustrates a section of retransfer film with another example of obscuring a residual image.

Like reference numbers represent like features throughout.

DETAILED DESCRIPTION

The following description describes a number of techniques for obscuring residual images on print ribbons that have been used to print on plastic cards. Obscuring the residual images on the print ribbons prevents access to sensitive or personalized data appearing in the residual images. Cards that are encompassed by the term "plastic cards" often bear printed personalized data unique to or assigned specifically to the cardholder, such as the name of the cardholder, an account number, an image of the face of the cardholder, and other data. In some embodiments, the cards can include a magnetic stripe and/or integrated circuit chip that holds/stores personalized data unique to or assigned specifically to the cardholder. Unauthorized access to the personalized data can be used for illegitimate purposes, such as creating a fraudulent plastic card, making unauthorized purchases, or identity theft.

The plastic cards can be financial (e.g., credit, debit, or the like) cards, driver's licenses, national identification cards, business identification cards, gift cards, and other plastic or composite cards which bear personalized data unique to or assigned specifically to the cardholder and/or which bear other card information. The term "plastic card" as used herein is intended to encompass cards that are completely or substantially plastic, as well as cards that have non-plastic or composite components and cards having other formulations that function like the card types indicated above.

In the techniques described herein, an image is printed on a retransfer film using a print ribbon, thereby creating a residual image of the printed image on the print ribbon. The image can be a portion of the, or the entire, image that is ultimately transferred onto the card. The retransfer film is also used to obscure some or all of the residual image on the print ribbon by transferring ink from the section of the print ribbon containing the residual image onto the retransfer film. The obscuring of the residual image on the print ribbon occurs before the printed image is transferred from the retransfer film onto the surface of the plastic card. In other embodiments, especially with color printing using multiple color panels, obscuring of the residual images on all of the color panels can occur before the printed image is transferred from the retransfer film onto the surface of the plastic card; or the residual image on one color panel can be obscured before transferring the printed image to the card followed by obscuring residual images on the color panels; or the residual images on two or more color panels can be obscured before transferring the printed image to the card followed by obscuring any remaining residual images on any remaining color panels.

The printed image on the retransfer film, and the resulting residual image on the print ribbon, can be text such as, but not limited to, a personal account number of the plastic card, the name of the intended cardholder, an expiration date, a card verification value (CVV) number, and the like. The printed image on the retransfer film, and the resulting residual image on the print ribbon, can also be a graphical image such as, but not limited to, a portrait image of the intended cardholder, and the like. The printed image can also be a combination of text and a graphical image.

Figure 1:
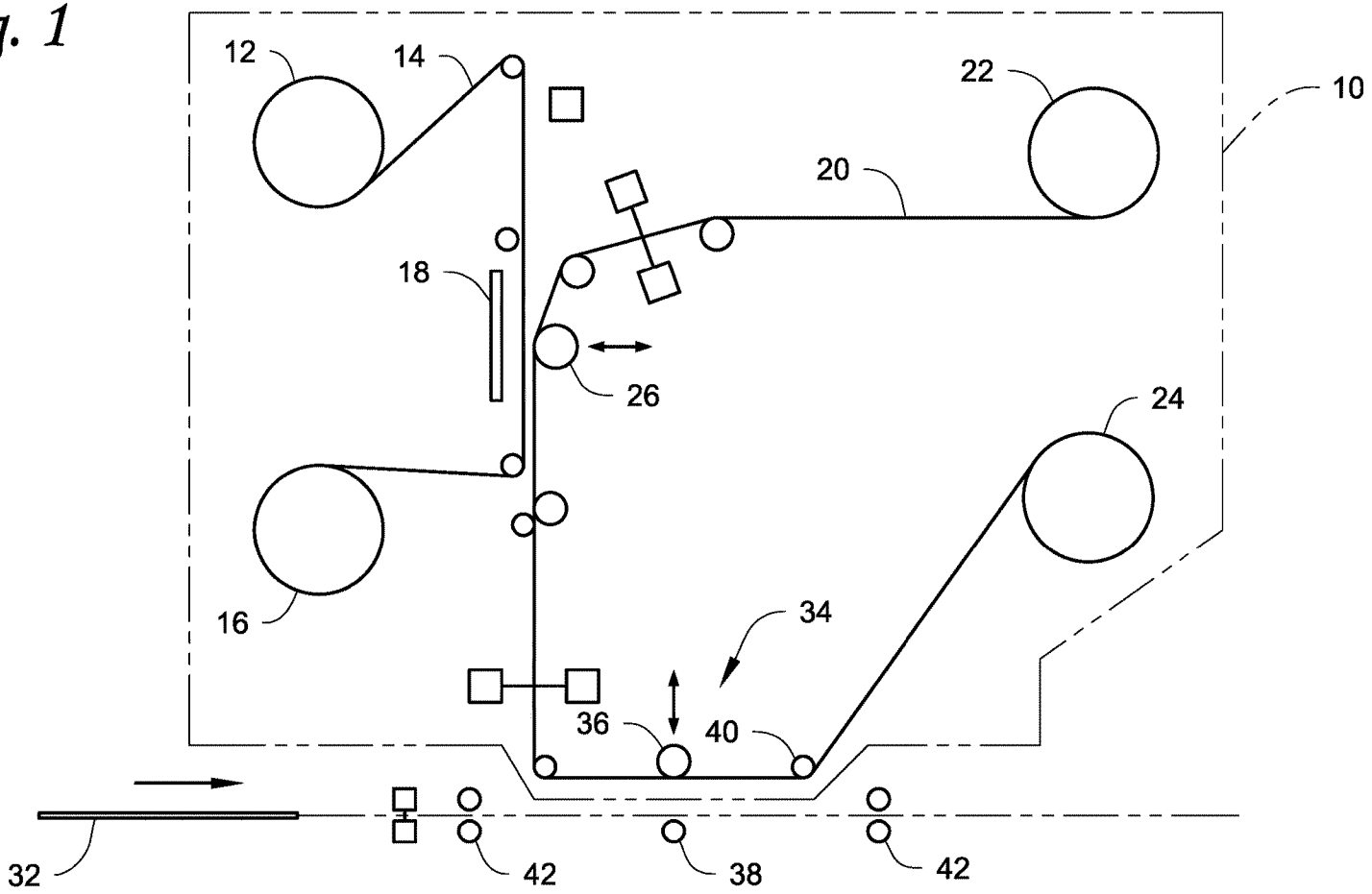
FIG. 1 illustrates a portion of a plastic card printing mechanism used in a plastic card processing mechanism.

Referring initially to FIG. 1, an example of a plastic card printing mechanism 10 in a plastic card processing mechanism is illustrated on which the techniques described herein can be implemented. The printing mechanism 10 is configured to perform retransfer printing. The specific construction and operation of retransfer printers, including the print ribbon, the retransfer film, printing an image on the retransfer film, and transferring the printed image onto a surface of a card, is well known in the art. One example of retransfer printing is disclosed in U.S. Pat. No. 6,894,710 among many others. U.S. Pat. No. 6,894,710 is incorporated herein by reference in its entirety.

The illustrated retransfer printing configuration of the printing mechanism 10 includes a print side that includes a print ribbon supply 12 from which a supply of print ribbon 14 is supplied, and a print ribbon take-up 16 that takes-up used print ribbon 14. The print ribbon is directed past a print head 18, which in the illustrated example can be stationary, and which conducts printing using the print ribbon 14 onto a retransfer film 20. After printing, the used print ribbon 14 is then wound onto the take-up 16.

Figure 2:
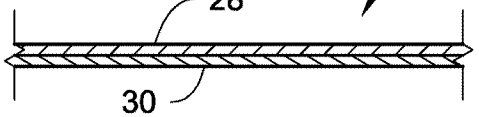
FIG. 2 is a cross-sectional view of a portion of a retransfer film.

The retransfer film 20 is supplied from a film supply 22 on a retransfer side, and after retransfer the remaining film 20 is wound onto a film take-up 24 also on the retransfer side. The retransfer film 20 is directed past a platen roller 26 positioned opposite the print head 18 and which in the illustrated example can be moved toward and away from the print head 18 to press the retransfer film 20 and the print ribbon 14 between the print head 18 and the platen roller 26 during printing onto the retransfer film 20. Referring to FIG. 2, the retransfer film 20 can be any retransfer film 20 that has a transferrable printing receptive layer(s) 28 disposed on a carrier film 30. The image is printed on the transferrable printing receptive layer(s) 28, and a portion of the printing receptive layer(s) 28 bearing the printed image is then transferred onto a plastic card 32. The carrier film 30 and any remaining printing receptive layer(s) 28 not transferred onto the card are ultimately wound onto the film take-up 24.

If monochromatic printing is being performed, the print ribbon 14 and the retransfer film 20 can be directed past the print station (i.e. the print head 18 and the platen roller 26) a single time or in a single pass to print the image on the retransfer film 20. In monochromatic printing, the print ribbon 14 may be a monochromatic print ribbon bearing a single color of ink such as, but not limited to, black, gold or silver ink. The monochromatic print ribbon may also include primer material separate from the ink color to improve the quality of the transfer of the ink from the retransfer film 20 onto the plastic card 32.

Alternatively, multi-color printing can be performed whereby the print ribbon 14 and the retransfer film 20 can be directed past the print station (i.e. the print head 18 and the platen roller 26) multiple times or in multiple passes, one pass for each color. For multi-color printing, the print ribbon 14 may be a multi-color print ribbon bearing discrete panels of differently colored inks arranged in a repeating sequence. For example, the print ribbon 14 can include cyan (C), magenta (M), yellow (Y) and black (K) ink panels (i.e. a CMYK ribbon). The print ribbon 14 can include additional colored ink panels such as gold or silver, and/or panels of primer material, and/or panels of specialty materials such as fluorescent material.

Returning to FIG. 1, once the image is completely printed, the section of the retransfer film 20 with the printed image is then advanced to a transfer station 34 where the transferrable printing receptive layer(s) 28 bearing the printed image is transferred onto the surface of the card 32. In this example, the transfer station 34 includes a heated transfer mechanism 36, for example a transfer roller, that is movable toward and away from a fixed platen 38 positioned on the opposite side of a card travel or transport path. The heated transfer mechanism 36 presses the portion(s) of the retransfer film 20 containing the printed image against the card 32 which is backed by the platen 38, with the retransfer film 20 and the card 32 then being transported together past the heated transfer mechanism 36 to transfer the printing receptive layer(s) of the retransfer film 20 containing the printed image onto the card surface. The retransfer film 20 and the card 32 are then transported to a stripping station 40 where the printing receptive layer(s) 28 of the retransfer film 20 is stripped from the card 32 leaving behind the printing receptive layer(s) 28 bearing the printed image on the card 32. The remainder of the retransfer film 20, minus the transferred printing receptive layer(s) 28, is then wound onto the film take-up 24. The card 32 is transported along the card travel path by a card transport mechanism well known in the art, such as sets of rollers 42.

The layout and content of the printed image can be implemented using suitable card design, issuance and management software known in the art. One example of a suitable card design, issuance and management software that can be used is the Entrust Datacard™ TruCredential software available from Entrust Datacard Corporation of Shakopee, Minn.

Regardless of whether monochromatic or multi-color printing is being performed, some or all of the printed image to be applied to the card 32 is printed on the printing receptive layer(s) 28 of the retransfer film 20 using the print ribbon 14. The transfer of the ink from the print ribbon 14 creates a residual image of the printed image on the print ribbon 14. As discussed in further detail below, the residual image on the print ribbon 14 can be obscured using the techniques described herein, and thereafter the printing receptive layer(s) 28 bearing the printed image is transferred to the card 32. However, in the case of color printing using color panels, the residual images on one or more of the color panels can be obscured, followed by transferring the printed image, followed by obscuring any remaining residual images on any remaining color panels.

Referring to FIGS. 3A-E, an example of obscuring a residual image on a section of a print ribbon bearing a single color ink is illustrated. To facilitate describing this embodiment, it will be assumed that the single color ink is black ink. However, the ink could be any single color other than black including, but not limited to, silver, gold, and other colors. The black ink may be present on the print ribbon in discrete panels or sections, or the black ink may be a continuous layer on the print ribbon.

Figures 3A, 3B, 3C, 3D, 3E:
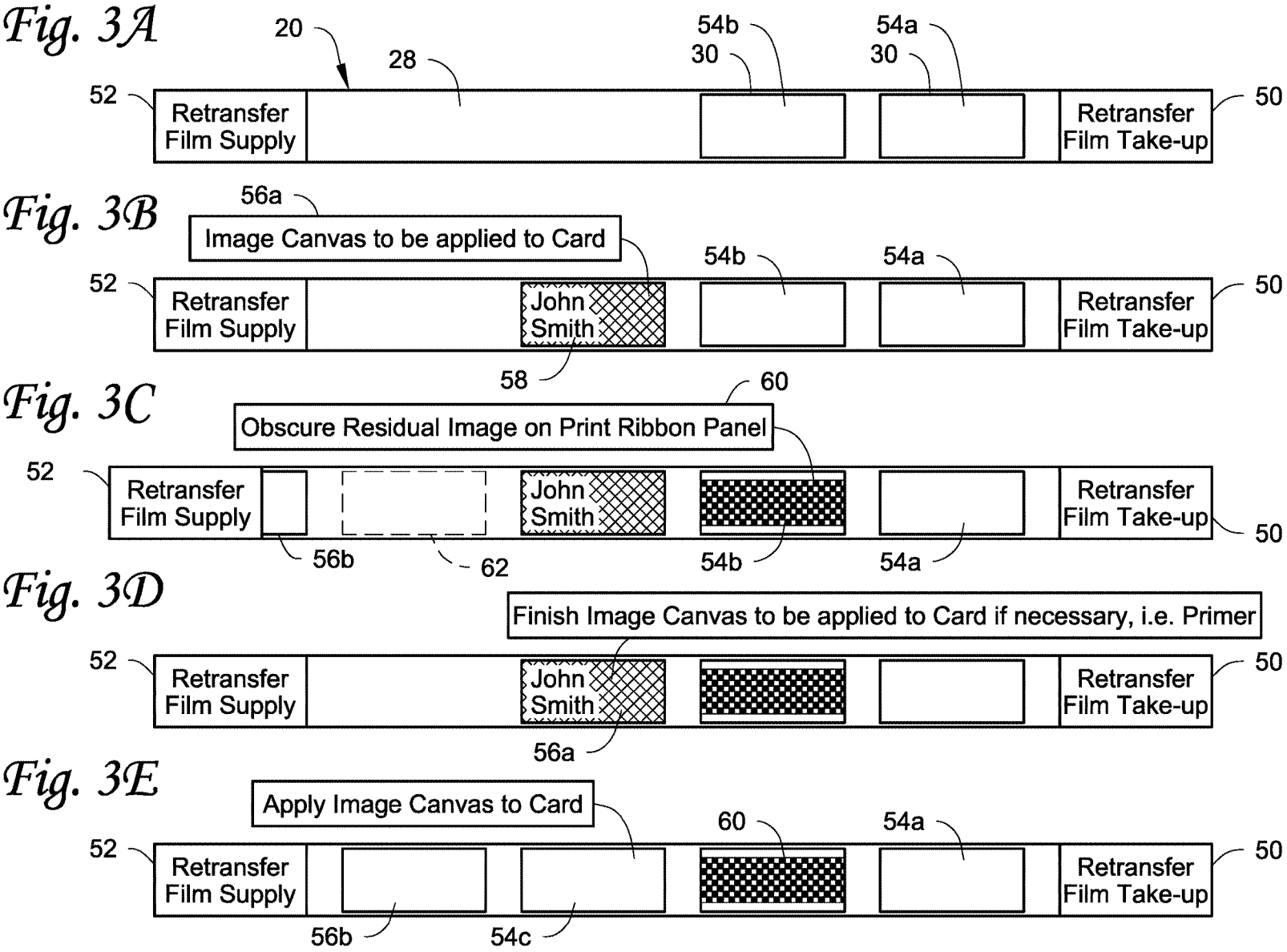

FIG. 3A illustrates an example starting arrangement of the retransfer film 20. In this example, the retransfer film 20 has a take-up (or leading) end 50 that is secured to the film take-up 24 (FIG. 1), and a supply (or trailing) end 52 that is secured to the film supply 22 (FIG. 1). This example assumes that a pair of images have previously been printed on the retransfer film 20 and transferred onto respective cards. The area on the retransfer film 20 where an image is to be printed and ultimately transferred to a card will be referred to as an image canvas. FIG. 3A illustrates two areas 54*a*, 54*b* (each referred to as a spent image canvas) where an image has been previously printed and ultimately transferred to their respective cards. In the spent image canvas areas 54*a-b*, the printing receptive layer(s) 28 each bearing a printed image(s) have been transferred to the cards, thereby exposing the carrier film 30 in each spent image canvas 54*a-b*.

An image canvas is the area of the printing receptive layer(s) 28 that is to be transferred to the surface of the card 32. In the illustrated embodiment, each spent image canvas 54*a*, 54*b* has a size that generally corresponds to the size of the surface of the card 32, indicating that the size of the printing receptive layer(s) 28 transferred to the card surface generally corresponds to the size of the card surface. However, the image canvas need not correspond in size to the surface of the card 32.

FIG. 3B illustrates the start of printing. An image canvas 56*a* is indicated on the retransfer film 20 (in actual practice, the outline or border indicating the image canvas 56*a* appearing in FIG. 3B to help facilitate an understanding of the innovation described herein does not actually appear on the retransfer film 20), and a monochromatic (for example, black) image 58 has been printed on the printing receptive layer(s) of the retransfer film within the image canvas 56*a* by transferring black ink from the print ribbon. In this example, the image 58 is text of the name, JOHN SMITH, of the intended cardholder. A residual image of the text (i.e. JOHN SMITH) is created in the panel or other section of the print ribbon from which the ink was transferred.

Assuming the resulting residual image in the print ribbon 14 is to be obscured, the print ribbon 14 (see FIG. 1) is reversed to reposition the print ribbon 14 for printing using the same ribbon panel or section of print ribbon used to print the image 58. In addition, referring to FIG. 3C, the retransfer film 20 is reversed to align the spent image canvas 54*b* with the print ribbon panel/section containing the residual image to be obscured. As depicted in FIG. 3C, an obscuring image or obscuring pattern 60 is then printed from the print ribbon panel/section containing the residual image onto the spent image canvas 54*b* by transferring additional ink from the print ribbon panel/section containing the residual image. Because of this additional transfer of ink, the residual image in the print ribbon panel/section is obscured by the printing of the obscuring image 60 which creates a residual image of the obscuring image 60 on the print ribbon panel/section over the original residual image (e.g. JOHN SMITH in this example). The residual image of the obscuring image 60 obscures the original residual image on the print ribbon 14, preventing a casual viewer of the print ribbon from discerning the residual image on the print ribbon 14.

The obscuring image 60 that is printed can be any obscuring image that results in an obscuring residual image on the print ribbon 14 overlaying the original residual image that is sufficient to obscure the original residual image. In addition, the obscuring image 60 on the retransfer film 20 should also be chosen so that the obscuring image 60 is unintelligible or unclear to a casual viewer of the retransfer film 20. The obscuring image 60, and the obscuring residual image on the print ribbon 14 resulting therefrom, need not occupy the entire image canvas. Instead, the obscuring image 60 and the obscuring residual image on the print ribbon 14 resulting therefrom need only occupy enough area to sufficiently obscure some or all of the residual image JOHN SMITH on the print ribbon 14. In addition, the obscuring image 60, and the obscuring residual image resulting therefrom, could be multiple or separate images, for example one obscuring image obscuring the text JOHN in the residual image on the print ribbon 14 and one obscuring image obscuring the text SMITH in the residual image on the print ribbon 14.

With continued reference to FIG. 3C, instead of reversing the retransfer film 20 to align the spent image canvas 54*b* with the ribbon panel/section containing the residual image to be obscured, the retransfer film 20 can be advanced to align an area 62 of the retransfer film 20 with the ribbon panel/section containing the residual image to be obscured, followed by printing the obscuring image 60 in the area 62. The area 62 contains fresh or unused portions of the printing receptive layer(s) 28 (FIG. 2). The area 62 would not be transferred but instead provides an area to form the obscuring image 60. The next image canvas 56*b* to contain a printed image to be transferred would then be generated next to the area 62 as depicted in FIG. 3C.

FIG. 3D illustrates an optional step where the image canvas 56*a* to be applied to the card is finished (if necessary). For example, a primer material can optionally be applied from the print ribbon to the image 58.

Once the printed image in the image canvas 56*a* is completed, the retransfer film 20 is advanced to the transfer station 34 (FIG. 1) and the image canvas 56*a* is transferred to the surface of the card 32 by transferring the printing receptive layer(s) bearing the printed image to the card surface. Referring to FIG. 3E, a new spent image canvas 54*c* is thereby created where the printing receptive layer(s) bearing the image canvas 56*a* has been transferred to the card, and the next image canvas 56*b* can then be generated on the retransfer film 20 next to the spent image canvas 54*c* and the spent image canvas 54*c* can then be used to obscure, in the manner described above, the next residual image in the print ribbon resulting from printing in the new image canvas 56*b*.

FIGS. 4A-I illustrate an example of obscuring residual images on panels of a multi-color print ribbon. This example assumes that the multi-color print ribbon is a CMYK print ribbon. In this example, the residual image is obscured on each color panel after each color panel is used to print. Features in common with features in FIGS. 3A-E are referenced using the same reference numbers.

Figures 4A, 4B, 4C, 4D, 4E:
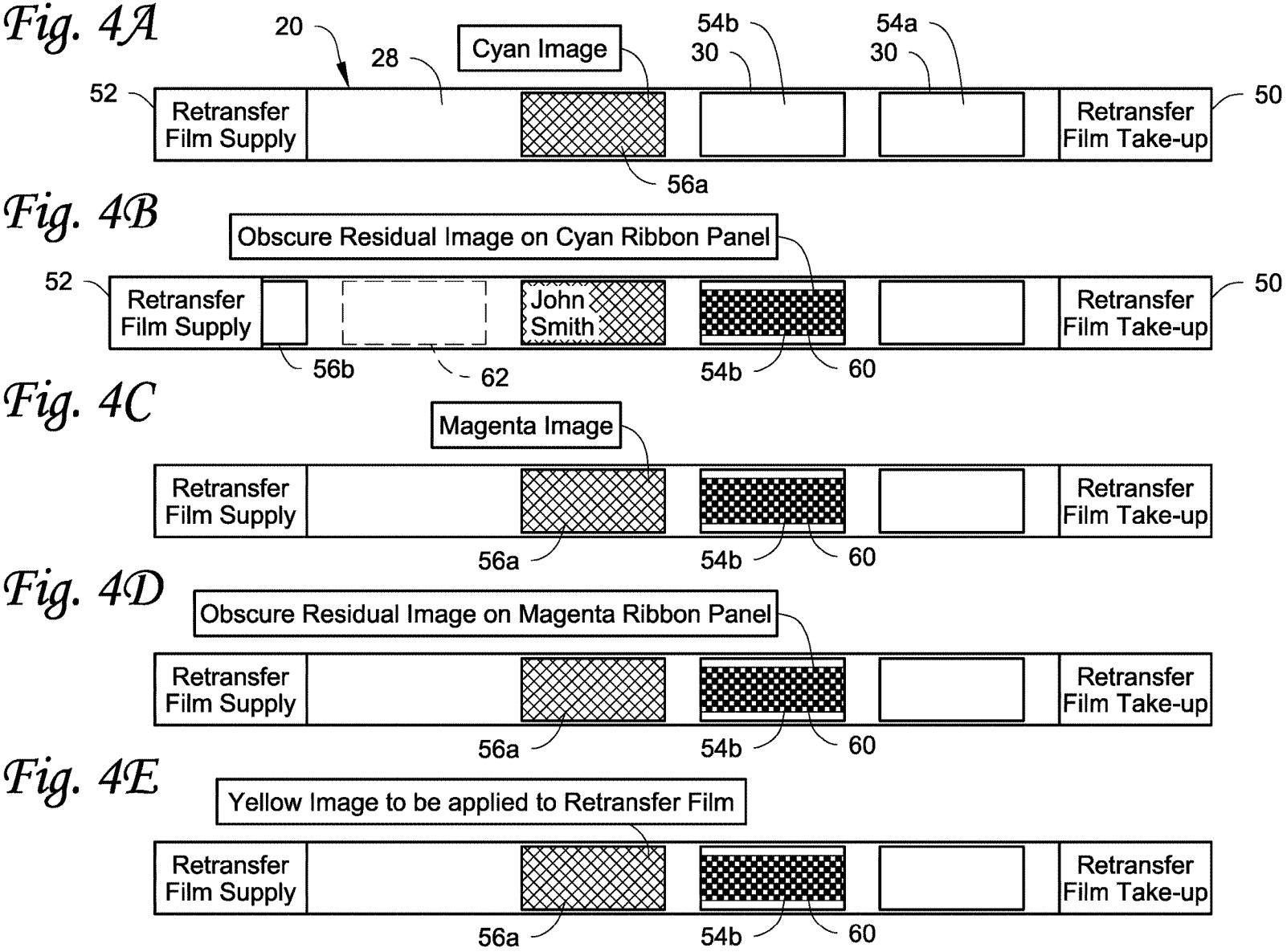

Referring to FIG. 4A, the retransfer film 20 has the take-up (or leading) end 50 that is secured to the film take-up 24 (FIG. 1), and the supply (or trailing) end 52 that is secured to the film supply 22 (FIG. 1). The two spent image canvasses 54*a*, 54*b* are indicated where images have been previously printed and ultimately transferred to their respective cards. In this example, printing starts by a cyan image being printed within the image canvas 56*a* by transferring ink from the C-colored panel on the print ribbon (in actual practice, the outline or border indicating the image canvas 56*a* appearing in FIG. 4A to help facilitate an understanding of the innovation described herein does not actually appear on the retransfer film 20). The cyan image can be text or a portion of an image such as a portrait image of the intended cardholder. A resulting residual image of the cyan image is created in the C-colored panel of the print ribbon from which the cyan colored ink was transferred.

Assuming the residual image in the C-colored panel is to be obscured, the print ribbon 14 (see FIG. 1) is reversed to reposition the print ribbon 14 for printing using the same C-colored panel used to print the cyan image. In addition, referring to FIG. 4B, the retransfer film 20 is reversed to align the spent image canvas 54*b* with the C-colored panel containing the residual image to be obscured. As depicted in FIG. 4B, the obscuring image 60 is then printed from the C-colored panel containing the residual image onto the spent image canvas 54*b* by transferring additional cyan ink from the C-colored panel containing the residual image. Because of this additional transfer of cyan ink, the reverse image in the C-colored panel is obscured by the printing of the obscuring image 60 which creates an obscuring residual image of the obscuring image 60 on the C-colored panel over the original residual image. The obscuring residual image of the obscuring image 60 obscures the original residual image, preventing a casual viewer of the print ribbon from discerning the original residual image in the C-colored panel.

Referring to FIG. 4C, printing can continue by appropriately aligning the image canvas 56*a* with the M-colored panel and printing a magenta image (if necessary) within the image canvas 56*a* by transferring ink from the M-colored panel on the print ribbon. The magenta image can be text or a portion of an image such as a portrait image of the intended cardholder. A resulting residual image of the magenta image is created in the M-colored panel of the print ribbon from which the magenta colored ink was transferred. Referring to FIG. 4D, the retransfer film 20 is again reversed to align the spent image canvas 54*b* with the M-colored panel containing the residual image to be obscured. As depicted in FIG. 4D, the obscuring image 60 is then printed from the M-colored panel containing the residual image onto the area 54*b* by transferring additional magenta ink from the M-colored panel containing the residual image. Because of this additional transfer of magenta ink, the residual image in the M-colored panel is obscured by the printing of the obscuring image 60 which creates an obscuring residual image of the obscuring image 60 on the M-colored panel over the original residual image. The obscuring residual image of the obscuring image 60 obscures the original residual image, preventing a casual viewer of the print ribbon from discerning the original residual image in the M-colored panel. The obscuring image 60 used for the M-colored panel can be the same obscuring image 60 used for the C-colored panel, or the obscuring image 60 used for the M-colored panel could be different than the obscuring image 60 used for the C-colored panel.

Figure 4F:
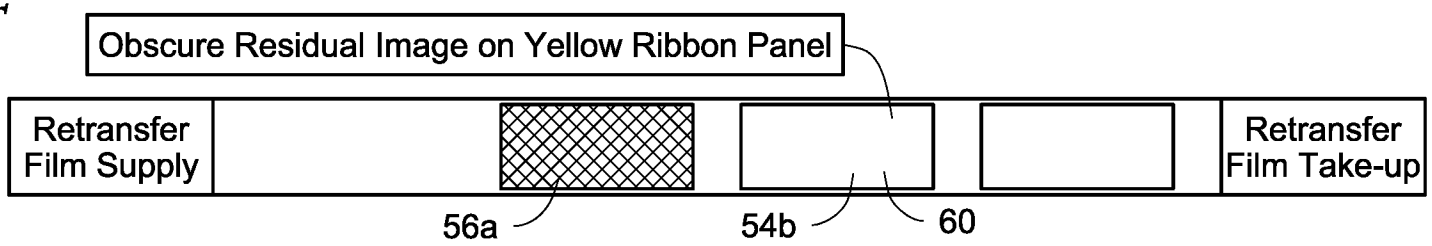

Referring to FIG. 4E, printing continues by appropriately aligning the image canvas 56*a* with the Y-colored panel and printing a yellow image (if necessary) within the image canvas 56*a* by transferring ink from the Y-colored panel on the print ribbon. The yellow image can be text or a portion of an image such as a portrait image of the intended cardholder. A resulting residual image of the yellow image is created in the Y-colored panel of the print ribbon from which the yellow colored ink was transferred. Referring to FIG. 4F, the retransfer film 20 is again reversed to align the spent image canvas 54*b* with the Y-colored panel containing the residual image to be obscured. As depicted in FIG. 4F the obscuring image 60 is then printed from the Y-colored panel containing the residual image onto the area 54*b* by transferring additional yellow ink from the Y-colored panel containing the residual image. Because of this additional transfer of yellow ink, the residual image in the Y-colored panel is obscured by the printing of the obscuring image 60 which creates an obscuring residual image of the obscuring image 60 on the Y-colored panel over the original residual image. The obscuring residual image of the obscuring image 60 obscures the original residual image, preventing a casual viewer of the print ribbon from discerning the original residual image in the Y-colored panel. The obscuring image 60 used for the Y-colored panel can be the same obscuring images 60 used for the C-colored panel and the M-colored panel, or the obscuring image 60 used for the Y-colored panel could be different than the obscuring images 60 used for the C-colored panel and the M-colored panel.

Figure 4G:
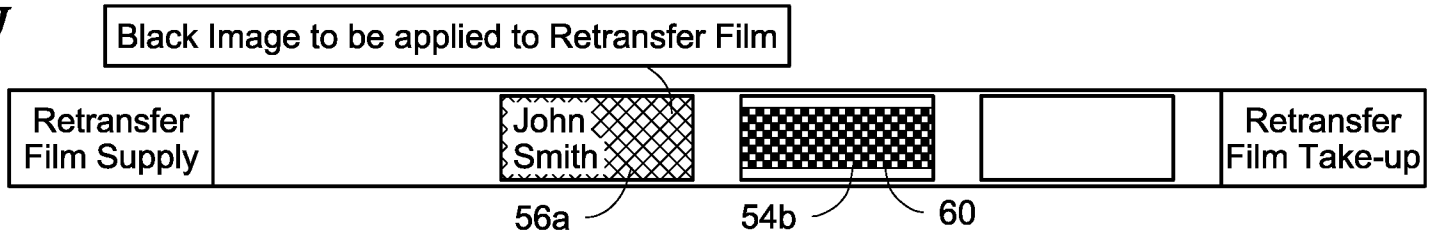
Figure 4H:
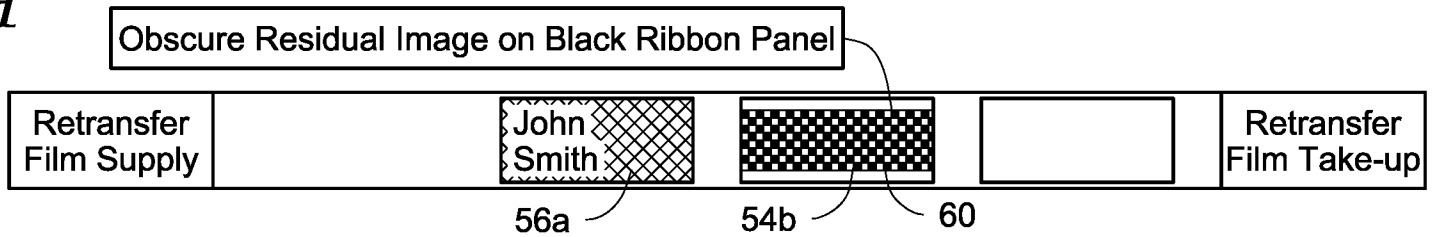

Referring to FIG. 4G, printing continues by appropriately aligning the image canvas 56*a* with the K-colored panel and printing a black image (if necessary) within the image canvas 56*a* by transferring ink from the K-colored panel on the print ribbon. The black image can be text (such as JOHN SMITH) or a portion of an image such as a portrait image of the intended cardholder. A resulting residual image of the black image is created in the K-colored panel of the print ribbon from which the black colored ink was transferred. Referring to FIG. 4H, the retransfer film 20 is again reversed to align the spent image canvas 54*b* with the K-colored panel containing the residual image to be obscured. As depicted in FIG. 4H, the obscuring image 60 is then printed from the K-colored panel containing the residual image onto the spent image canvas 54*b* by transferring additional black ink from the K-colored panel containing the residual image. Because of this additional transfer of black ink, the residual image in the K-colored panel is obscured by the printing of the obscuring image 60 which creates an obscuring residual image of the obscuring image 60 on the K-colored panel over the original residual image. The obscuring residual image of the obscuring image 60 obscures the original residual image, preventing a casual viewer of the print ribbon from discerning the original residual image in the K-colored panel. The obscuring image 60 used for the K-colored panel can be the same obscuring image 60 used for the C, M and Y colored panels, or the obscuring image 60 used for the K-colored panel could be different than the obscuring image 60 used for the C, M and Y-colored panels.

Similarly to the variation discussed above for FIGS. 3A-E, instead of reversing the retransfer film 20 to align the spent image canvas 54*b* with the ribbon panel/section containing the residual images to be obscured, the retransfer film 20 can be advanced to align an area 62 with the CMYK-colored panels containing the residual images to be obscured, followed by printing the obscuring images 60 in the area 62 as shown in FIG. 4B. The area 62 contains fresh or unused portions of the printing receptive layer(s). The area 62 would not be transferred but instead provides an area to form the obscuring images 60. The next image canvas 56*b* would then be generated next to the area 62.

In an optional step similar to that discussed above for FIG. 3D, the image canvas 56*a* to be applied to the card can be finished (if necessary), for example by applying a primer material from the print ribbon to the image.

Figure 4I:
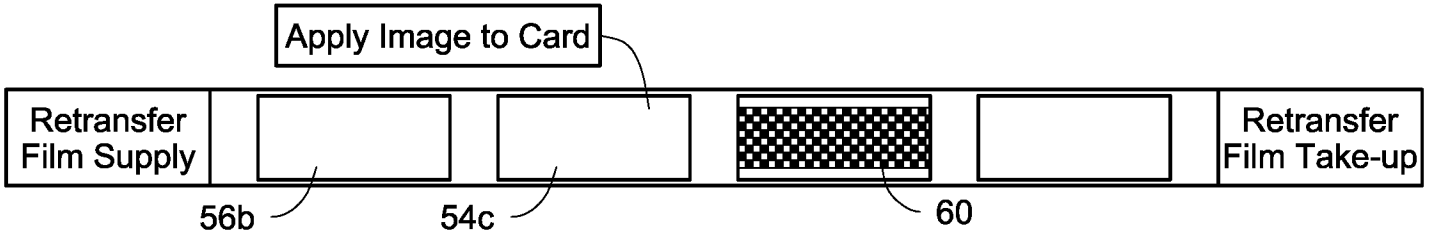

Once the printed image in the image canvas 56*a* is completed, the retransfer film 20 is advanced to the transfer station 34 (FIG. 1) and the image canvas 56*a* is transferred to the surface of the card 32. Referring to FIG. 4I, a new spent image canvas 54*c* is created where the printing receptive layer(s) 38 bearing the image canvas 56*a* has been transferred to the card, and the next image canvas 56*b* can then be generated next to the spent image canvas 54*c* and the spent image canvas 54*c* can be used to obscure the next residual images in the CMYK print ribbon.

In the above example, the residual images on each of the C, M, Y, and K-colored panels are obscured before the printed image is transferred to the card surface. However, other sequences are possible. For example, the residual image(s) on one or more of the colored panels can be obfuscated, followed by transferring the printed image to the card surface, followed by obfuscating the residual image(s) on the remaining colored panels used to create the printed image. In one non-limiting example, assuming an image is printed using the CMY-colored panels, one could obfuscate the residual image on the C-colored panel, followed by transferring the printed image, followed by obfuscating the residual images on the M and Y-colored panels. In another non-limiting example, assuming an image is printed using the CMY-colored panels, one could obfuscate the residual images on the C and M-colored panels, followed by transferring the printed image, followed by obfuscating the residual image on the Y-colored panel. In still another non-limiting example, assuming an image is printed using the CMYK-colored panels, one could obfuscate the residual images on the C, M and Y-colored panels, followed by transferring the printed image, followed by obfuscating the residual image on the K-colored panel. Other sequences of residual image obscuration and printed image transfer are possible.

The obscuring image(s) 60 can be pre-selected by the card design, issuance and management software. In another embodiment, a user of the plastic card printing mechanism 10 is able to select the obscuring image(s) 60 to be used to obscure the residual image(s) left behind on the print ribbon. Based on the selected obscuring image(s) 60, the residual image(s) are obscured as described above.

In one embodiment, the user can be permitted to enter the obscuration image(s) the user wishes to use. In another embodiment, the user can be presented a list of selectable obscuration images, and the user can select one or more of the obscuration images with the selected obscuration image(s) then being used to obscure the residual image(s).

As explained above, the obscuring image(s) 60 needs to be selected so that the residual image(s) on the print ribbon is not readily readable. In addition, the obscuring image(s) 60 should also be selected so that the information that one is trying to obscure is not readable on the retransfer film 20 upon printing the obscuring image(s) 60 on the retransfer film. To highlight this concept, assume the name JOHN SMITH above in FIGS. 3A-E where JOHN SMITH is printed using a panel or other section of the print ribbon. If one selects an extreme example where the obscuring image 60 is chosen so that all of the remaining ink from the print ribbon panel/section used to print JOHN SMITH is printed onto the retransfer film 20 such as in the spent image canvas 54*b*, this would obscure JOHN SMITH on the print ribbon panel/section since one could no longer casually read JOHN SMITH on that panel/section. However, the name JOHN SMITH would now be readable on the retransfer film 20 in the spent image canvas 54*b* due to the transfer of all of the ink from the print ribbon panel/section, with JOHN SMITH being formed by areas in the spent image canvas 54*b* that are devoid of ink. So the obscuring image(s) 60 that is used should prevent reading of the data on the print ribbon as well on the retransfer film. The obscuring image(s) 60 that is selected can be chosen to obscure a predetermined percentage of the residual image(s) on the print ribbon that is sufficient to obscure the data and prevent casual reading of the data. In one non-limiting example, the obscuring image(s) 60 can be selected to leave about 50% of the data that one wants to obscure on the print ribbon with about 50% of the data being printed onto the retransfer film 20 in the obscuring image 60. However, many other obscuring percentages are possible.

FIGS. 3A-E and 4A-I illustrate the obscuring images 60 as occupying substantially the entire spent image canvas 54*b*. However, the obscuring image(s) 60 need only occupy sufficient area to result in obscuring the residual image(s) on the print ribbon. For example, FIG. 5 illustrates an example of the obscuring image 60 that is an elongated rectangle. In the example of FIG. 5, the obscuring image 60 could be suitable for obscuring a residual image of an account number, the name of the intended cardholder, a CVV number, or an address line. FIG. 6 illustrates an example of the obscuring image 60 that is substantially a square. In the example of FIG. 6, the obscuring image 60 could be suitable for obscuring a residual image of a portrait image of the intended cardholder.

The techniques described herein can be implemented in any type of plastic card printing mechanism that uses retransfer printing. The plastic card printing mechanism can be used in a desktop plastic card printer that has a relatively small footprint intended to permit the desktop plastic card printer to reside on a desktop and that is designed to personalize plastic cards in relatively small volumes, for example measured in tens or low hundreds per hour. An example of a desktop plastic card printer is the CD800 Card Printer available from Entrust Datacard Corporation of Shakopee, Minn. Additional examples of desktop printers are disclosed in U.S. Pat. Nos. 7,434,728 and 7,398,972, each of which is incorporated herein by reference in its entirety. The plastic card printing mechanism can also be part of a large volume batch plastic card production machine, often configured with multiple processing stations or modules, typically referred to as a central issuance system, that processes multiple plastic cards, at the same time and is designed to personalize plastic cards in relatively large volumes, for example measured in the high hundreds or even thousands per hour. An example of a central issuance system is the MX or MPR-lines of central issuance systems available from Entrust Datacard Corporation of Shakopee, Minn. Additional examples of central issuance systems are disclosed in U.S. Pat. Nos. 4,825,054, 5,266,781, 6,783,067, and 6,902,107, all of which are incorporated herein by reference in their entirety. In some embodiments, the card printer (desktop or central issuance) can include a mechanism to read and/or write data to a magnetic strip and/or a mechanism to program an integrated circuit chip on the plastic card.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A print ribbon obscuration method, comprising:

printing an image on a retransfer film by transferring ink from a section of a print ribbon onto a transferrable printing receptive layer of a first section of the retransfer film thereby forming a residual image of the image on the section of the print ribbon; and thereafter obscuring the residual image on the section of the print ribbon by transferring ink from the section of the print ribbon onto a second section of the retransfer film that is spaced from the first section bearing the image.

2. The print ribbon obscuration method of claim 1, wherein the retransfer film is supplied from a retransfer film supply;

moving the retransfer film in a feed direction while printing the image onto the first section of a retransfer film; and one of the following:

moving the retransfer film in the feed direction to position the second section of the retransfer film relative to the print ribbon prior to transferring ink from the section of the print ribbon onto the second section of the retransfer film; or moving the retransfer film in a direction opposite the feed direction to position the second section of the retransfer film relative to the print ribbon prior to transferring ink from the section of the print ribbon onto the second section of the retransfer film.

3. The print ribbon obscuration method of claim 1, wherein the retransfer film includes a leading end and a trailing end; and one of the following: the second section is positioned between the first section and the leading end, or the second section is positioned between the first section and the trailing end.

4. The print ribbon obscuration method of claim 1, wherein the retransfer film includes a carrier film and the transferrable printing receptive layer is carried by the carrier film, and one of the following: the second section of the retransfer film is an area devoid of the transferrable printing receptive layer, or the second section of the retransfer film contains the transferrable printing receptive layer.

5. The print ribbon obscuration method of claim 1, wherein the ink transferred from the section of the print ribbon onto the transferrable printing receptive layer of the first section of the retransfer film is black-colored ink, cyan-colored ink, magenta-colored ink, or yellow-colored ink.

6. The print ribbon obscuration method of claim 1, wherein the ink transferred from the section of the print ribbon onto the transferrable printing receptive layer of the first section of the retransfer film is black-colored ink; and after obscuring the residual image, printing a primer material over the black-colored ink on the transferrable printing receptive layer of the first section of the retransfer film, and thereafter transferring the transferrable printing receptive layer of the first section bearing the printed image to a surface a plastic card.

7. The print ribbon obscuration method of claim 6, wherein the plastic card comprises a financial card having at least one of a magnetic stripe and an integrated circuit chip.

8. The print ribbon obscuration method of claim 1, wherein the image printed on the retransfer film and the residual image on the section of the print ribbon comprises text.

9. A method of printing an image onto a surface of a plastic card, comprising:

printing at least a portion of the image onto a transferrable printing receptive layer of a retransfer film by transferring ink from a print ribbon onto the transferrable printing receptive layer thereby forming a residual image on the print ribbon;

obscuring the residual image on the print ribbon;

after obscuring the residual image, transferring the transferrable printing receptive layer bearing the printed image onto the surface of the plastic card.

10. The method of claim 9, wherein the print ribbon comprises a repeating sequence of color panels including cyan, magenta, yellow and black ink panels;

transferring ink from a first one of the color panels onto the transferrable printing receptive layer of the retransfer film to form at least a portion of the image and thereby forming a residual image on the first color panel;

obscuring the residual image on the first color panel;

transferring ink from a second one of the color panels onto the transferrable printing receptive layer of the retransfer film to form at least a portion of the image and thereby forming a residual image on the second color panel;

obscuring the residual image on the second color panel;

after obscuring the residual images on the first color panel and on the second color panel, transferring the transferrable printing receptive layer bearing the printed image onto the surface of the plastic card.

11. The method of claim 9, wherein the plastic card comprises a financial card having at least one of a magnetic stripe and an integrated circuit chip.

12. The method of claim 9, wherein the image printed on the transferrable printing receptive layer and the residual image on the print ribbon comprises text.

13. A method of operating a plastic card printing mechanism, comprising:

allowing a user of the plastic card printing mechanism to select an obscuration pattern to be used to obscure a residual image left behind on a print ribbon resulting from a print operation performed by the plastic card printing mechanism;

receiving a user input of a selected obscuration pattern;

the plastic card printing mechanism obscuring the residual image on the print ribbon based on the received user input.

14. The method of claim 13, further comprising presenting to the user a list of selectable obscuration patterns, and allowing the user to select one of the obscuration patterns.

15. The method of claim 13, wherein the plastic card printing mechanism is a retransfer printing mechanism where the print ribbon is used to print an image on a transferrable printing receptive layer of a retransfer film, followed by the transferrable printing receptive layer bearing the printed image being transferred to a surface of the plastic card; and obscuring the residual image occurs before the transferrable printing receptive layer bearing the printed image is transferred to the surface of the plastic card.

16. The method of claim 15, wherein the image printed on the transferrable printing receptive layer and the residual image on the print ribbon comprises text.

17. The method of claim 13, wherein the plastic card comprises a financial card having at least one of a magnetic stripe and an integrated circuit chip.

* * * * *